United States Patent [19]

Cavaliéri et al.

[11] 4,106,753

[45] Aug. 15, 1978

[54] AUTOMATIC ANTI-FALL DEVICE FOR POWER-DRIVEN LIFTING MACHINERY

[75] Inventors: Michel Cavaliéri; Francois Batréau, both of Neuilly sur Marne, France

[73] Assignee: Europe-Levage Manutention (Elma), Bagnolet, France

[21] Appl. No.: 708,820

[22] Filed: Jul. 26, 1976

[30] Foreign Application Priority Data

Jul. 30, 1975 [FR] France ..... 75 23722
Dec. 24, 1975 [FR] France ..... 75 39657

[51] Int. Cl.[2] ..... B66D 5/04

[52] U.S. Cl. ..... 254/157; 182/112; 188/65.1; 188/188; 254/156

[58] Field of Search ..... 254/156, 157, 159, 173 R, 254/174; 182/112; 187/89, 90, 91, 81; 188/188, 65.1, 65.2, 65.3

[56] References Cited

U.S. PATENT DOCUMENTS

| | | | |
|---|---|---|---|
| 853,733 | 5/1907 | Pratt | 187/91 |
| 1,165,583 | 12/1915 | Farmer | 188/188 X |
| 3,273,671 | 9/1966 | Vrana | 188/188 X |
| 3,669,223 | 6/1972 | Arnold | 188/188 |
| 3,936,622 | 2/1976 | McElroy | 254/173 R |
| 3,968,865 | 7/1976 | McElroy | 188/188 |

FOREIGN PATENT DOCUMENTS

| | | | |
|---|---|---|---|
| 1,580,173 | 7/1969 | France | 188/188 |

*Primary Examiner*—Drayton E. Hoffman
*Assistant Examiner*—Donald W. Underwood
*Attorney, Agent, or Firm*—William Anthony Drucker

[57] ABSTRACT

The device, adapted to be associated with a motorized hauling installation, comprises a self-clamping jaws block with a safety cable passing through it onto which the load can be transferred by clamping the jaws. The jaws block is connected by means of control rods to a mobile chassis of which one end is adapted to pivot, in case of a fall, about a fixed point of the casing, this pivoting action activating an electric detector which stops the machine motor. (FIG. 1).

3 Claims, 8 Drawing Figures

10
11
4a
3
7
22
20
38
2
40
13a
17

15
14
B
12
04
A1
9
28
6a
4a
29
02
3
M
42
23
27
10
8
25
24
38
7
11
22
E
D
20
21
39
C
41
5
1
01
2
16
43
S
42
40
13a
19
03
18
17

AUTOMATIC ANTI-FALL DEVICE FOR POWER-DRIVEN LIFTING MACHINERY

BACKGROUND OF THE INVENTION

1. Field of the Invention

The present invention concerns an automatic anti-fall device for power-driven lifting machinery; its use is more particularly adapted to equipping scaffolding nacelles.

2. Description of the Prior Art

Devices have already been proposed for use with lifting machinery, either solely in the event of a break in a cable-type lifting machine, or also in the event of a break in the bearer cable, in the anchoring appliance or in any part of the suspension gear, by using an auxiliary safety cable, which carries the load when any breakdown occurs on the main suspension.

The devices already proposed comprise, for example, a block of self-clamping jaws subject to pre-clamping which is subsequently cancelled by the action of the load on a rod system during normal operations, whereas these jaws are clamped together rapidly on the bearer cable or on the safety cable in the event of any breakdown on the normal suspension.

SUMMARY OF THE INVENTION

However, the devices that have already been proposed do not enable the motor or motors of the lifting machinery (when the latter is power-driven) to be stopped and this can entail inopportune movements. The main purpose of the present invention is to bring the motor or motors to a stop automatically in conjunction with the anti-fall action and in the event of an overload.

The invention has been designed to achieve this result with a minimum number of parts, so as to provide a simple and robust mechanism of the greatest efficacy with the maximum guarantees as regards safety.

For this purpose, the transfer of the load on the bearer cable to an auxiliary cable in the event of a fall is detected by means of a mechanism which also detects the appearance of any possible overload and then stops the plant's motor from both lifting and lowering. An organ, supplying the elastic reaction point of this detector mechanism, plays at the same time the role of a shock-absorber, thus reducing any dynamic effects that might be applied to the bearer cable or the auxiliary cable, which improves the system's functioning and makes for greater safety.

A mechanism for opening the self-clamping jaws block, sollicited by the action of the load applied to the bearer cable, transmits this action to the jaws block, in both an amplified and elastic manner. Furthermore, this amplified and elastic transmission makes it possible to reduce the answering time of the jaws block to ensure that the load is taken up by the auxiliary cable in the event of an accident. It also enables a manually controlled intervention to be applied, which, even when the load remains on the bearer cable, makes it possible to close the jaws on the auxiliary cable for the purpose of testing whether the mechanism is working properly or to transfer the load to the auxiliary cable for the purpose of replacing a defective piece of lifting machinery.

According to a characteristic forming part of the invention, an additional detector is provided, against which the anchoring rod thrusts, thus stopping the motor in the event of suppression or abnormal decrease of the load on the bearer cable without transfer of the load to the auxiliary cable. For example, when the machinery meets an obstacle during lowering operations, the intervention of this additional detector allows the machine to start lifting again, which is the contrary to what happens when the load is transferred to the auxiliary cable or in the event of an overload.

Besides, the invention provides an anti-fall device ensuring closure of the safety jaws block, not by means of action cancelling or decreasing the load on the bearer cable, but by crossing a cable-speed threshold in any given direction, detected by the device.

The safety jaws block is easily carried by a mobile part pivoting on one of its ends round a fixed point on the casing of the anti-fall device, and, at its other end, articulated on an elastic buffer acting as a shock-absorber, as indicated previously, in such a way that the mobile part can, by its movement, control a detector in pre-established conditions, which causes the plant's motor or motors to stop.

In order to make an appliance capable of dealing with a case of over-speed, the mobile chassis mentioned above must be fitted with a rotary mechanism, driven by the safety cable and releasing, by centrifugal action and for a given cable direction, a trigger set previously on the clamping mechanism, so as to free this mechanism and clamp the safety cable through the action of a spring. This rotary mechanism functions in the same way, whether the cable moves in relation to the device or whether the device moves in relation to the fixed cable. A manual control appliance enables the clamping mechanism to be reset when the load is not applied to the safety cable. To obtain an anti-fall device acting as well by cancelling the load as by crossing a cable-speed threshold, the above trigger may be released by spring returning an anchoring rod when this latter is no more submitted to the load.

DESCRIPTION OF THE PREFERRED EMBODIMENTS

Figure 2:
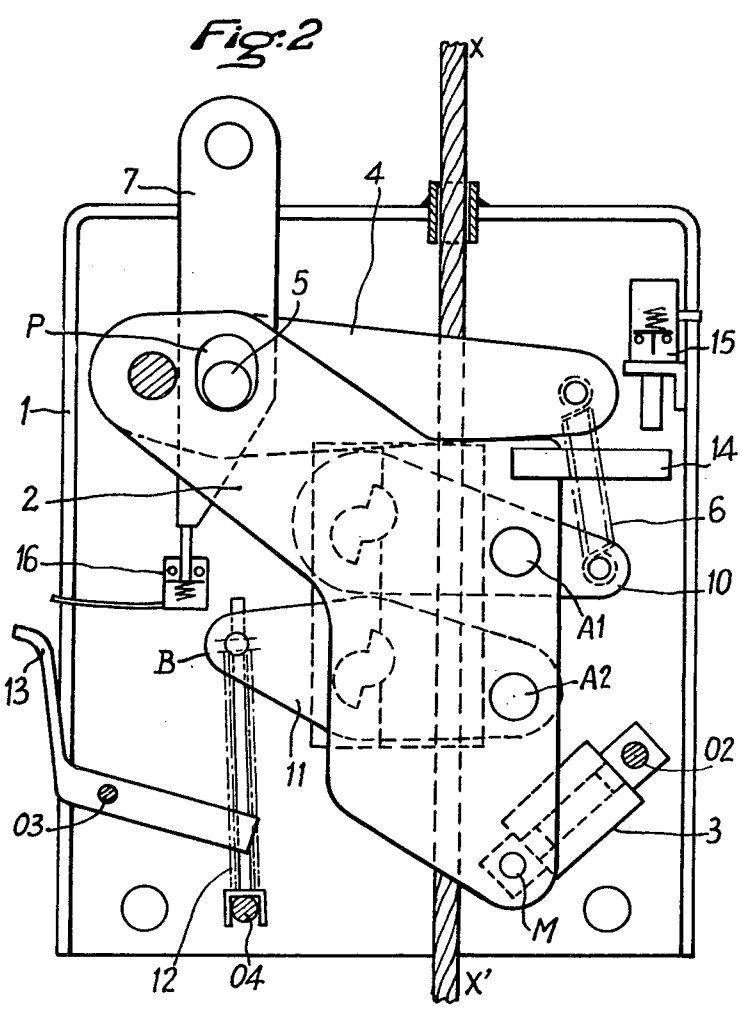
FIG. 2 shows the same device in the case where the load is taken up by a safety cable passing through the self-clamping jaws block, which is then in the closed position.
Figure 1:
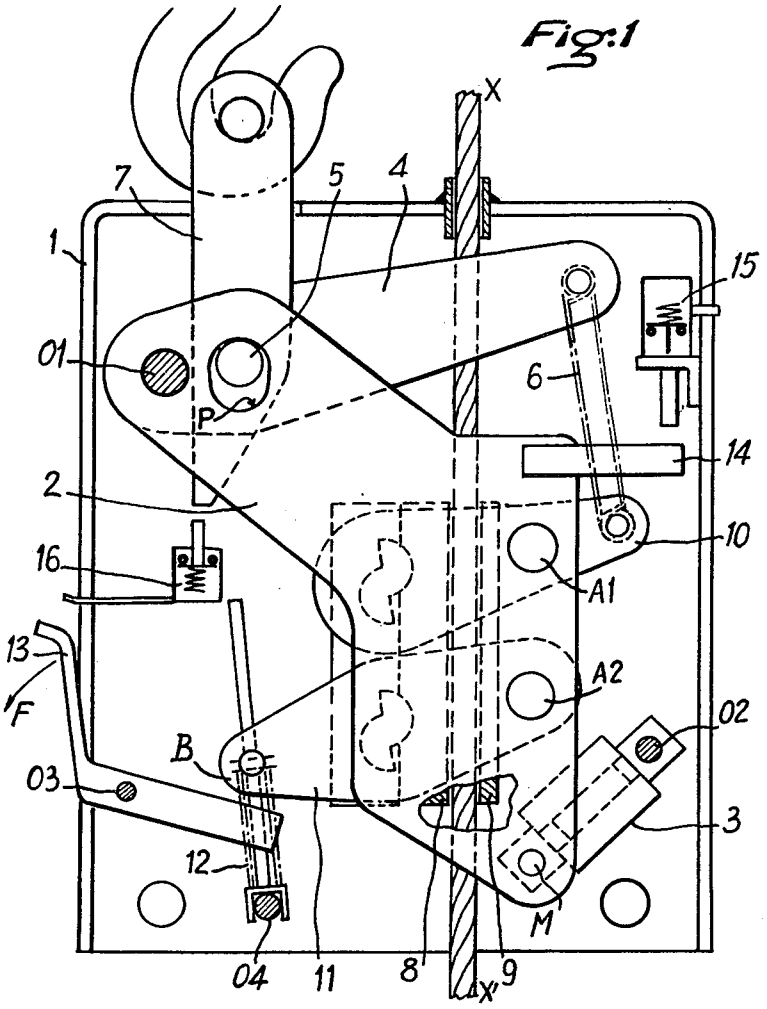
FIG. 1 shows a first form of embodiment of the invention with the device functioning normally, when the load is applied to the bearer cable and the jaws block open.

With reference first of all to FIGS. 1 and 2, it can be seen that the device according to the invention which is represented respectively in the neutral position and in the intervention position, comprises a casing 1 with one or more fixing points on its lower part for the load (not represented) and, on its upper part, an aperture for the anchoring rod 7 to pass through, which is directly connected to the mechanism described hereafter.

This casing 1 supplies the four fixed shafts, 01, 02, 03 and 04 for the mechanism. On the fixed point 01, a floating chassis 2 is articulated; it is composed of two parallel plates with an oblong aperture P through which the shaft 5 passes by which anchoring rod 7 is articulated with the rod 4 controlling the opening of the jaws block when the load is applied to rod 7. This rod 4 articulates at one of its end on a fixed point, which can be the fixed shaft 01, whereas its other end is connected to one end of the traction spring 6, whose other end is hooked onto the small clamping rod 10 on the jaws block.

The floating chassis 2 presents the articulation shafts A1 and A2 for the small clamping rods 10 and 11 on the jaws block, as well as shaft M connected to the fixed shaft 02 through an elastic buffer 3. It should be noted here that the floating chassis 2 makes it possible, either by its shape or by means of a part specially inserted 14, to provide a stop-block acting during the course of its movement on the electric detector 15 fixed onto the casing.

The jaws block is composed of two jaws 8 and 9, connected together and controlled by small clamping rods 10 and 11, according to a well-known system recalled systematically in the drawing by representation for each small clamping rod of a cam with two semi-circles of similar diameter but with offset centres, designed to operate in conjunction with the two jaws.

A pre-clamping compression spring 12 is pressed up against the fixed shaft 04 and on one end B of the clamping rod 11 so as to attract it in respect of closing the jaws block.

A lever 13, articulated on the shaft 03, enables the head B of the small rod 11 to be activated thus bringing the jaws into contact with the auxiliary spring.

In the example illustrated, the anchoring rod 7 extends downwards to near a circuit-breaker 16 designed to stop the lifting machine in the course of a lowering operation, during which an obstacle might remove the load from the bearer cable (from which rod 7 hangs) without transferring it to the auxiliary cable (passing through the jaws block). This circuit-breaker 16 enables the machine to start lifting operations again, contrarily to the action of the detector 15.

To explain the general functioning of the device, it should first be noted that the floating chassis 2 is attracted around 01 by a load applied either on the upper part of the oblong aperture P through the shaft 5 of the rod 7, or on the articulated jaws block at A1 and A2. In relation to the fixed point 01, each of these actions creates a couple, which is absorbed by the reaction of the elastic buffer 3. This buffer is compressed by the action of this couple in such a way that the floating chassis 2 can rotate according to an arc proportional to this couple. For a certain limit of this movement adjusted in advance, part 14 comes into contact with the electric contact-breaker 15 and stops the lifting machine, either in the event of an overload, or in the event of the load being taken up on the auxiliary cable.

Owing to the fact that the floating chassis, in conjunction with the elastic buffer, detects both an overload and the fact that the load has been taken up by the auxiliary cable, it is necessary to place the articulation of the anchor tie rod 7 between the fixed point 01 and the axis of the auxiliary cable XX' as near as possible to 01, so as to obtain as great a proportion as possible of the force, to be applied on the bearer cable to obtain an overload release, to the one to be applied on the auxiliary cable to obtain release due to loss of load.

To open the jaws 8–9 under the effect of the load applied to the bearer cable, control rod 4 is used, whose movement attracts spring 6 which activates the small rod 10 and causes the desired action. When the load ceases to be applied to the bearer cable, the small rod 4 is brought back by the spring 6, which, owing to this fact, becomes relaxed, enabling the closing action of the pre-clamping spring 12 to take place. This spring 12 allows relative independance of movement to the rods 4 and 10, while allowing the action of the control lever 13, which enables the jaws 8–9 to be closed at any moment, even the load remains applied to the bearer cable.

And so, action on the lever 13, articulated on shaft 03 and supported on the end B of the small clamping rod 11, in the direction of the arrow F, enables the jaws 8–9 to be brought manually into contact with the auxiliary cable. The advantage of this latter mechanism is that it enables the operator to check that the safety device is in good order and to have a defective part of the lifting machine replaced, by taking up the load by means of an auxiliary cable, whatever the position of the machine may be.

This lever 13 can itself be controlled by an electromagnetic control system, for example.

According to an alternative solution, the spring 6 and the rod 4 are replaced by an electro-magnet or any other control device opening the jaws block, itself controlled by a detector, which could be part 16 or any other part influenced by the movement of the anchoring tie rod. In this case, the lever 13 is replaced by an electric push-button or any other control device enabling the jaws to be clamped onto the cable without bringing the machine to a stop.

The device shown in FIGS. 3 to 6 comprises a unit similar to the one of FIGS. 1 and 2 but without the rod 4 and the spring 6, since, in this version, the jaws are not opened by applying the load to the bearer cable, but by means of manual setting manoeuvre. On the other hand, a spring 41, attached to the casing at one end, exercises pressure on shaft 5, so as to cause the rod 7 to move towards the circuit-closer 16, when the load applied on the bearer cable falls lower than a given value.

The pre-clamping spring 12 rests on the fixed shaft 04 and activates the end B of the small clamping rod 11 to attract it in the closing direction and it will be noted that the fixed shaft 04 could be supplied by the mobile chassis 2 instead of by the casing 1.

A lateral lever 40 is fitted onto and forms one with a fixed shaft 03, which itself forms one with a rotating arm 17, whose end C is connected through a spring **13*a* to the end D of the small clamping rod 11. The movement of the arm 17 is limited by stop-blocks 18 and 19** rigid with the casing.

When the small rods 10 and 11 are not attracted in the clamping direction by means of a load applied on the safety cable, movement of the lever 40 in the direction of arrow S brings the clamping rod 11 into a position enabling the trigger E of the part 20 fixed in rotation on the shaft 21 to become engaged on the shaft 22 of the rod 11. This has the effect of maintaining the clamping mechanism in the open position in spite of the action of the preclamping spring 12 acting in compression.

This manoeuvre is made possible owing to the fact that the action of the traction spring 13*a* is more powerful than the action of spring 12. The purpose of the spring 13*a* is to connect the arm 17 to the small rod 11, while at the same time providing sufficient elasticity to prevent the lever having a rigid action on the clamping mechanism in the event of the latter being clamped on the safety cable, while a minimum pre-selected load is applied on the latter. A stop-block acts in the same way to limit the travel of the lever 40. The spring 13*a* is calculated to behave practically like a rigid rod during the action of the lever 40, so as to open the jaws in a case where the load applied on the safety cable does not attain the value pre-selected.

The part 20, engaged previously on the shaft 22 of the small rod 11 by its trigger E, frees this shaft 22 when this part 20 is attracted towards rotation by thrust from a rod 23. This thrust is brought about by action of the rotary unit illustrated in FIGS. 5 and 6, operating in the following circumstances: a plate 24, pivoting on a shaft 25 fixed between the two sides of the mobile chassis, is rigid with a pulley 26 (FIG. 6) driven by movement of the whole device along the safety cable. A pulley 27 presses the cable against the pulley 26 through the action of a spring 6*a* anchored at a fixed point 28 by means of a rod 4*a*, which itself pivots on a shaft 29. The plate 24 bears two runners 30 and 31 respectively articulated on this plate at points 32 and 33. These runners are recalled towards the centre of the plate by the springs 34 and 35, which are adjustable. As a result of this adjustment, and for a given rotation speed, the runner finding itself in a privileged position through gravity moves away from the centre of the plate, so that one of the stop-blocks 36 or 37 hits one of the folded back ends R1 and R2 of the branches of the part 38. The latter is thus driven round in rotation and pushes the rod 23, articulated between this part 38 and the part 20, in such a way as to make part 20 pivot; its hook E then lets the shaft 22 of the small clamping rod 11 escape, which activates the clamping mechanism in closing direction as a result of the effect of the pre-clamping spring 12. A spring 39 stabilizes the position of the engaging part 20 after release of the trigger E.

Figure 4:
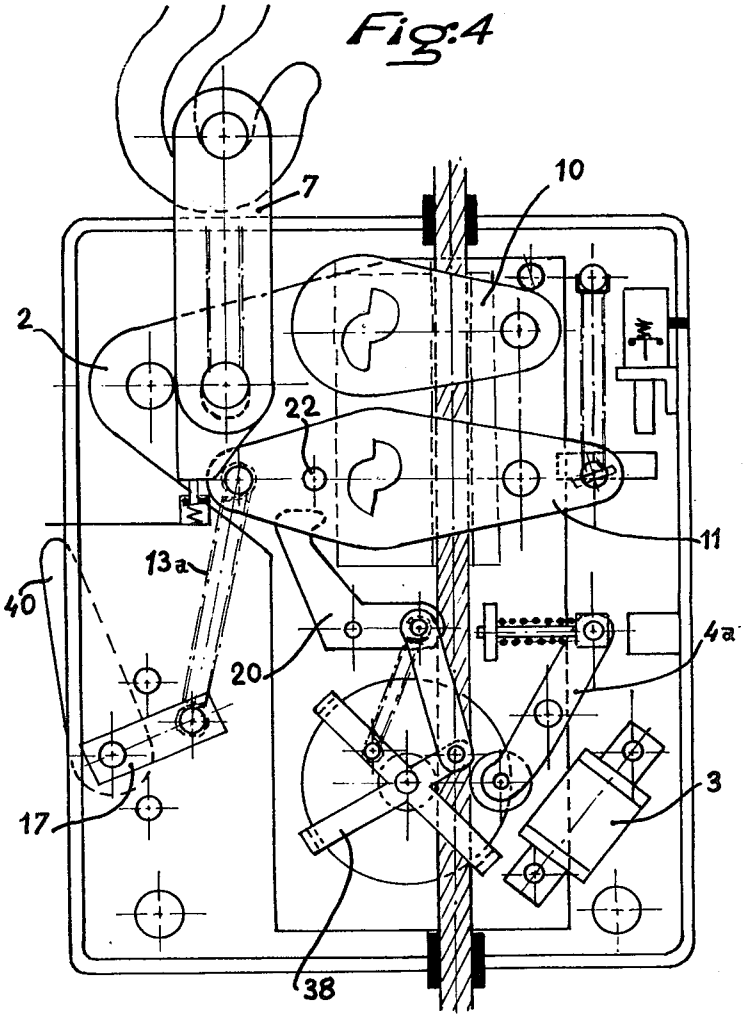
FIG. 4 shows the device in FIG. 3 in the clamped position on the safety cable after release of the cocking appliance.
Figure 3:
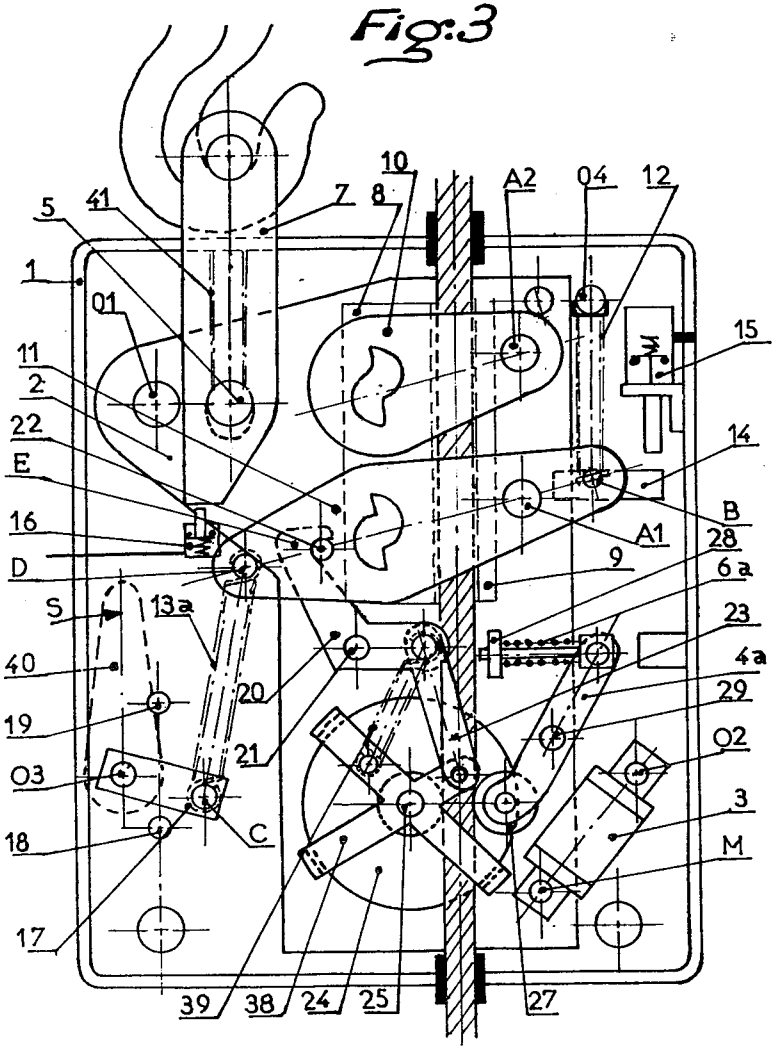
FIG. 3 shows a device answering to an over-speed, represented with normal functioning, the jaws being maintained open.
Figure 6:
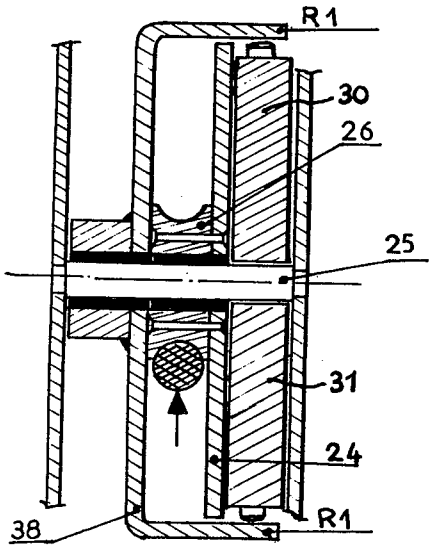
FIGS. 5 and 6 show the rotary mechanism detecting over-speed and fitted with mobile runners which, under the effect of a given minimum speed, move away from the rotation shaft and activate the release mechanism freeing the clamping action of the jaws on the safety cable.
Figure 5:
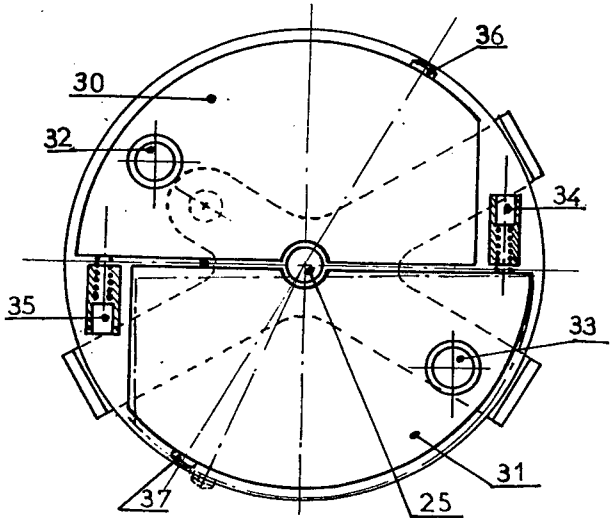
Figure 8:
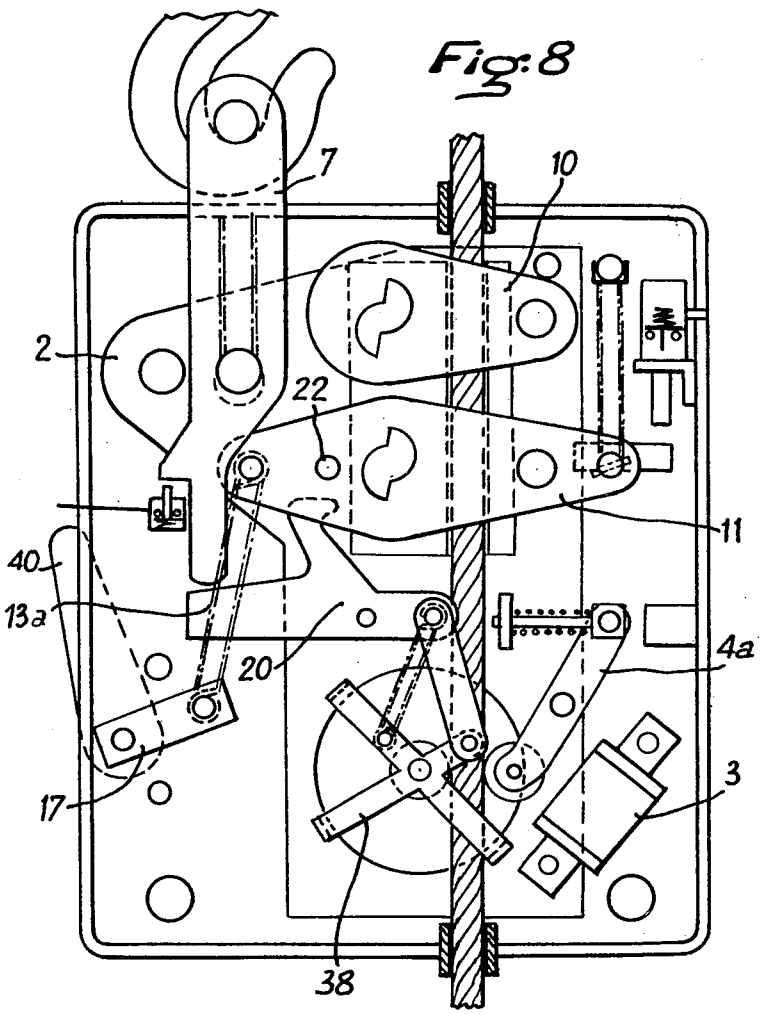
FIGS. 7 and 8 are similar to FIGS. 3 and 4 but show a modified mechanism adapted to answer as well to an overload as to a cancelling or abnormal decrease of the load.
Figure 7:
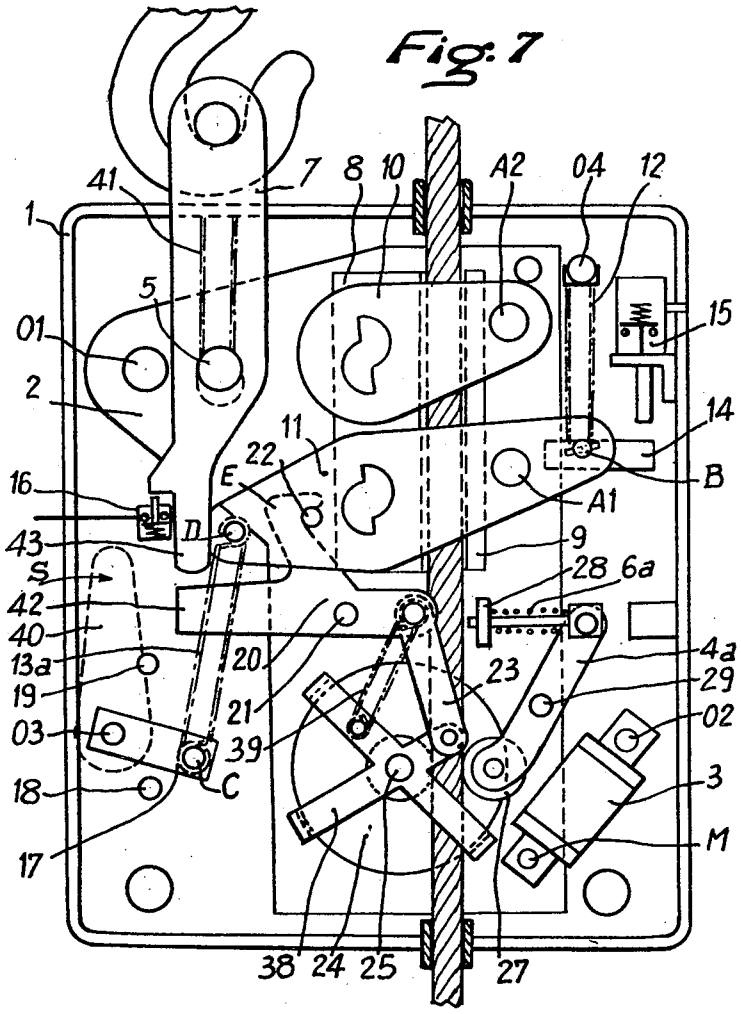

According to FIGS. 7 and 8, which show a modification of the device of FIGS. 3 and 4 allowing the safety releasing as well by lowering the load under a predetermined value as by crossing an overload threshold, the part 20 presents an extension 42 extending below the end portion 43 of the anchoring rod 7, in such a manner that in the event of loss of the load, that is of cancelling or abnormal decreasing of the load applied to the anchoring rod 7, this latter is pushed back by spring 41 to engage with its end portion 43 the extension 42 of part 20 thus causing part 20 to pivot in the release direction and consequently allowing an immediate clamping of the jaws block on the safety cable and the stop of the plant's motor or motors.

What we claim is:

1. An automatic anti-fall device, for use on a motor-driven lifting machine having a bearer cable for attachment of a load to be lifted, said device comprising (i) a carrier structure having means for attachment of the load (ii) a first pivot means on said carrier structure (iii) a bearer member mounted on said first pivot means for movement in a vertical plane (iv) connecting means for connecting said bearer member to the bearer cable (v) a cable clamping assembly including (a) clamping means (b) control means for the clamping assembly pivotably mounted on said bearer member for movement in a vertical plane, and (c) means resiliently urging the clamping means into clamping condition, (vi) an auxiliary safety cable positioned vertically between said clamping means (vii) a lever pivotably mounted on said carrier structure for movement in a vertical plane, (viii) coupling means coupling said lever to said connecting means, (ix) resilient linking means connecting said lever to said clamping control means for holding said clamping means open when load is applied to the carrier structure, (x) a first control for the motor of the lifting machine, said control being mounted on the carrier structure, said control being positioned in relation to said bearer member such that, upon occurrence of a predetermined extent of vertical pivoting movement of said bearer member under excessive load as well as when the load is transferred to the auxiliary safety cable, said bearer member actuates said first control to stop the motor, (xi) resilient means connected to said carrier structure and to said bearer member and opposing vertical pivoting movement of said bearer member, (xii) a second control for the motor of the lifting machine, said control being mounted on the carrier structure and being positioned in relation to an end portion of said connecting means such that, if the load decreases under a predetermined value, said connecting means actuates said second control to stop the motor, and (xiii) a control lever pivoted to said carrier structure and adapted to engage said control means to urge them into a position closing said clamping means on the auxiliary cable against the action of said resilient linking means.

2. An automatic anti-fall device, as claimed in claim 1, wherein said clamping means for the auxiliary cable are locked in open position by a locking member pivoted to the carrier structure and having one end engaging said control means, another end of said locking member being connected to a rotative system co-acting with said auxiliary cable and adapted, beyond a speed threshold of the auxiliary cable, to act by centrifugal action for pivoting said locking member and releasing said control means.

3. An automatic anti-fall device, as claimed in claim 2, wherein said locking member has, in the vicinity of said connecting means, an extension adapted to be engaged by said connecting means when the load applied to the bearer cable becomes lighter than a predetermined value so as to pivot said locking member for releasing the control means.

* * * * *